US005415240A

United States Patent [19]

Mundjar

[11] Patent Number: 5,415,240

[45] Date of Patent: May 16, 1995

[54] DRILLING DEVICE FOR A ROCK DRILL

[75] Inventor: Marjan Mundjar, Lohningen, Switzerland

[73] Assignee: SIG Schweizerische Industrie-Gesellschaft, Neuhaussen am Rheinfall, Switzerland

[21] Appl. No.: 113,648

[22] Filed: Aug. 31, 1993

[30] Foreign Application Priority Data

Aug. 31, 1992 [JP] Japan ..... 4-232294

[51] Int. Cl.[6] ..... B25D 9/20

[52] U.S. Cl. ..... 173/48; 173/105; 173/206

[58] Field of Search ..... 173/48, 206, 207, 105

[56] References Cited

U.S. PATENT DOCUMENTS

| | | | |
|---|---|---|---|
| 1,372,915 | 3/1921 | Smith | 173/105 |
| 1,658,330 | 2/1928 | Gilman | 173/105 |
| 3,044,448 | 7/1962 | Curtis et al. | 173/105 |
| 3,307,638 | 3/1967 | Kurt | 173/105 |
| 3,403,738 | 10/1968 | Burkhart et al. | 173/48 |
| 4,006,783 | 2/1977 | Granholm | 173/105 |
| 5,060,734 | 10/1991 | Anderson et al. | 173/206 |
| 5,064,003 | 11/1991 | Nerozhikov et al. | 173/105 |

*Primary Examiner*—Scott A. Smith
*Attorney, Agent, or Firm*—Browdy and Neimark

[57] ABSTRACT

The invention concerns a rock drill (2) for activating a rotatable and reciprocable drill steel assembly (FIG. 1). A reversible motor (50) is coupled to a striking bar (3) for rotating the drill steel. The striking bar is struck by a percussion piston (10). A rotary fluid valve (15) is operating the piston. A disconnectable coupling (37,38,43) in normal operation couples both the valve (15) and the striking bar (3) with the motor (50). In special modes the motor operates only the percussion piston, e.g. for retracting a drill rod, or only rotates the striking bar (3), e.g. for connecting and disconnecting drill rods.

13 Claims, 3 Drawing Sheets

DRILLING DEVICE FOR A ROCK DRILL

BACKGROUND OF THE INVENTION

This invention relates to a drilling device for a rock drill with a rotary drive for the drill steel and a percussion mechanism.

A hydraulic rock drill is known through U.S. Pat. No. 4,064,950 in which the control valves for percussion power and rotation speed are located in the control panel apart from the rock drill itself. Furthermore, the percussion apparatus and the rotation motor have separate hydraulic circuits. The maximum percussion power is adjusted by a pressure relief valve in the hydraulic circuit of the percussion mechanism and the maximum rotation power is adjusted by a pressure relief valve in the hydraulic circuit of the percussion mechanism.

With such drilling devices it sometimes happens that the drill steel gets jammed and cannot be rotated further. When under such conditions the percussion mechanism continues to strike the drill steel, it can happen that the latter is driven into the rock and cannot be retracted any more.

In the German Offenlegungsschrift No. 34 39 268 a similar drilling device has been proposed where the percussion mechanism and the hydraulic motor are arranged in series. This device does not have the drawback mentioned above: When the hydraulic fluid cannot flow through the motor because the motor is stopped by the drill then no flow passes through the percussion mechanism. Therefore, percussion stops when the drill rod gets jammed. However, this prior art device has other drawbacks: The sum of the power output of the hydraulic motor and the percussion mechanism is constant but the power distribution between the two is indetermined.

In Swiss Patent No. 559 088 it was proposed to directly couple the percussion frequency with the rotation rate of the motor. However, with this proposal it is not possible to operate the percussion mechanism and the motor independently.

SUMMARY OF THE INVENTION

The object of the present invention is to create a drilling device which does not have the drawbacks mentioned above.

The drilling device of the present invention has a housing in which a striking bar is rotatably and reciprocably supported. The output shaft of a reversible fluid motor is coupled to the striking bar for rotating the drill steel. A percussion piston reciprocatingly received in a cylinder strikes on to the striking bar. A rotary fluid valve is connected to the cylinder. A releasable coupling selectively couples the output shaft with the rotary valve.

The rotary valve may have an additional independent drive motor or a second releasable coupling may be arranged between the output shaft and the striking bar. During normal operation the rotary valve is directly coupled with the output shaft of the drill motor. The percussion frequency is exactly proportional to the rotation rate of the drill steel. The angle which the drill head shifts between two successive blows by the percussion piston is always the same regardless of the rotation rate. It can be shown that this represents about the optimum adjustment of percussion frequency to the rotation rate which varies as the drill steel on its advance encounters rock formations of different properties and hardness.

This automatic internal adjustment of the percussion frequency, therefore, guarantees maximum drill performance in different rock formations.

If the drill steel for some reason gets jammed in the rock then the percussion stops immediately. It is therefore possible to reverse the direction of force on the drill steel and retract it. This saves considerable time and drilling equipment.

When retracting a drill steel which is assembled from a number of sections, these sections must be disconnected successively. To that end, the rear end of a following section still partly inserted in the drill bore is clamped. The threaded connection between that section and the previous section that is still clamped in the drilling device, can now be rattled loose by independently operating only the percussion mechanism. The previous section can now be unscrewed by operating the drill motor in the proper rotation sense which is contra to the drilling mode.

All these operations must be performed under remote control because generally operators are not permitted near the drilling process because of safety reasons due to the hazard of falling rock.

For the above reasons the drilling device according to the present invention guarantees an optimum use of the rock drills under various rock conditions. At the same time it allows remote control of coupling and uncoupling in the event of long hole drilling.

BRIEF DESCRIPTION OF THE DRAWINGS

Embodiments of the present invention will now be described with reference to the drawings, in which.

DETAILED DESCRIPTION OF PREFERRED EMBODIMENTS

Figure 1:
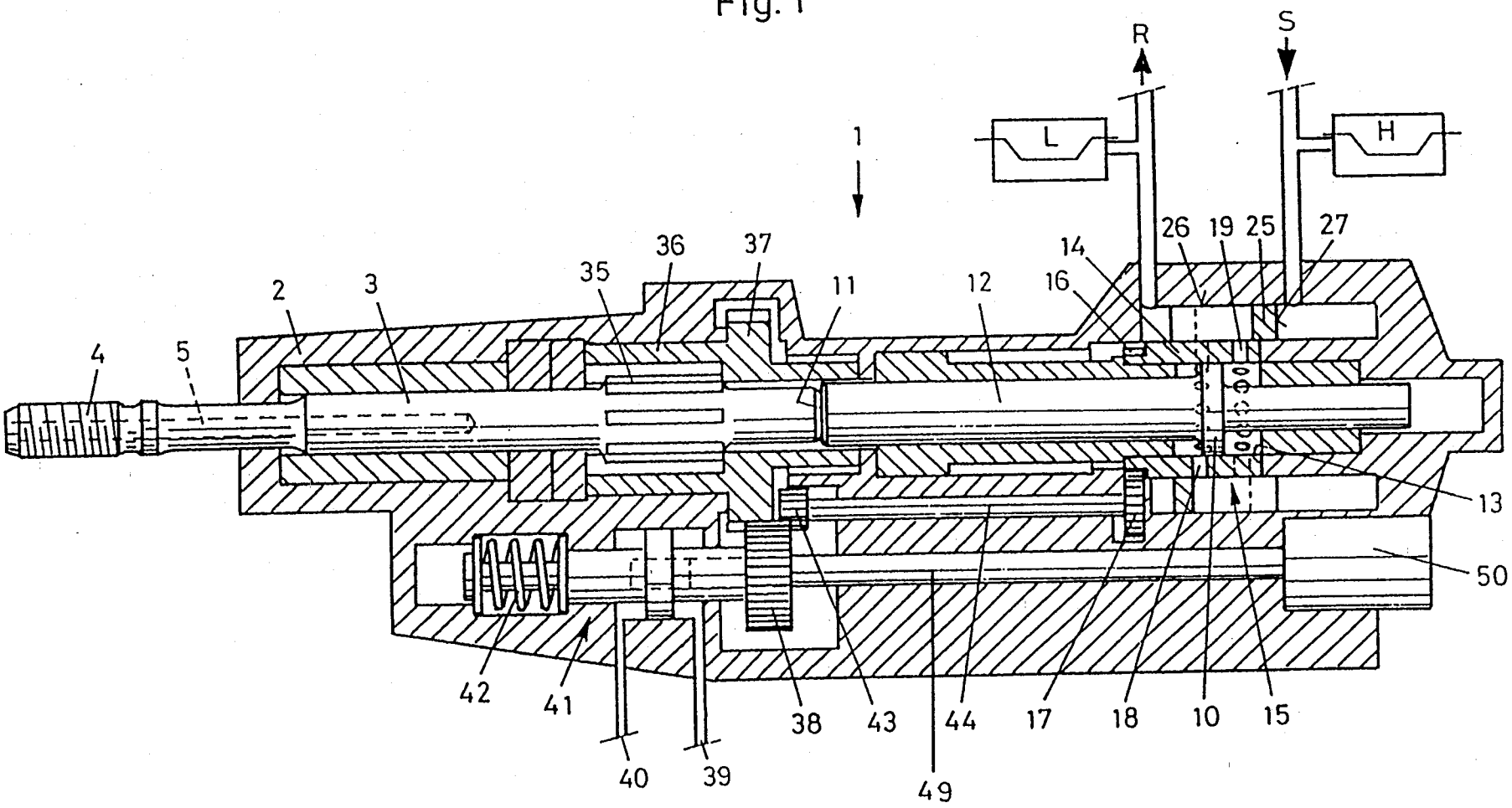
FIG. 1 shows a longitudinal section through a first embodiment.

The drilling device 1 according to FIG. 1 comprises a housing 2 which reciprocatingly and rotably activates a striking bar 3. On its forward end the striking bar 3 may have a male thread 4 for connecting the drill steel (not shown). The striking bar 3 also has an internal bore 5 for supplying a flushing fluid to the drill face via a connection (not shown) to the housing 2.

Coaxial with the striking bar a percussion piston 10 is reciprocatingly received in the housing 2. In operation the front face 11 of the piston rod 12 of piston 10 strikes against the rear face of the striking bar 3. The piston 10 slides in a bore 13 of a cylinder 14. The cylinder 14 is rotably supported in housing 2 and forms a first valve member of a rotary valve 15. On its forward end it bears gear teeth 16 linking with a pinion 17. The cylinder 14 has two sets of openings 18, 19 in two radial planes. The openings 18, 19 are regularly spaced in the circumferential direction, and the openings 18 are angularly offset against the openings 19.

Figure 2:
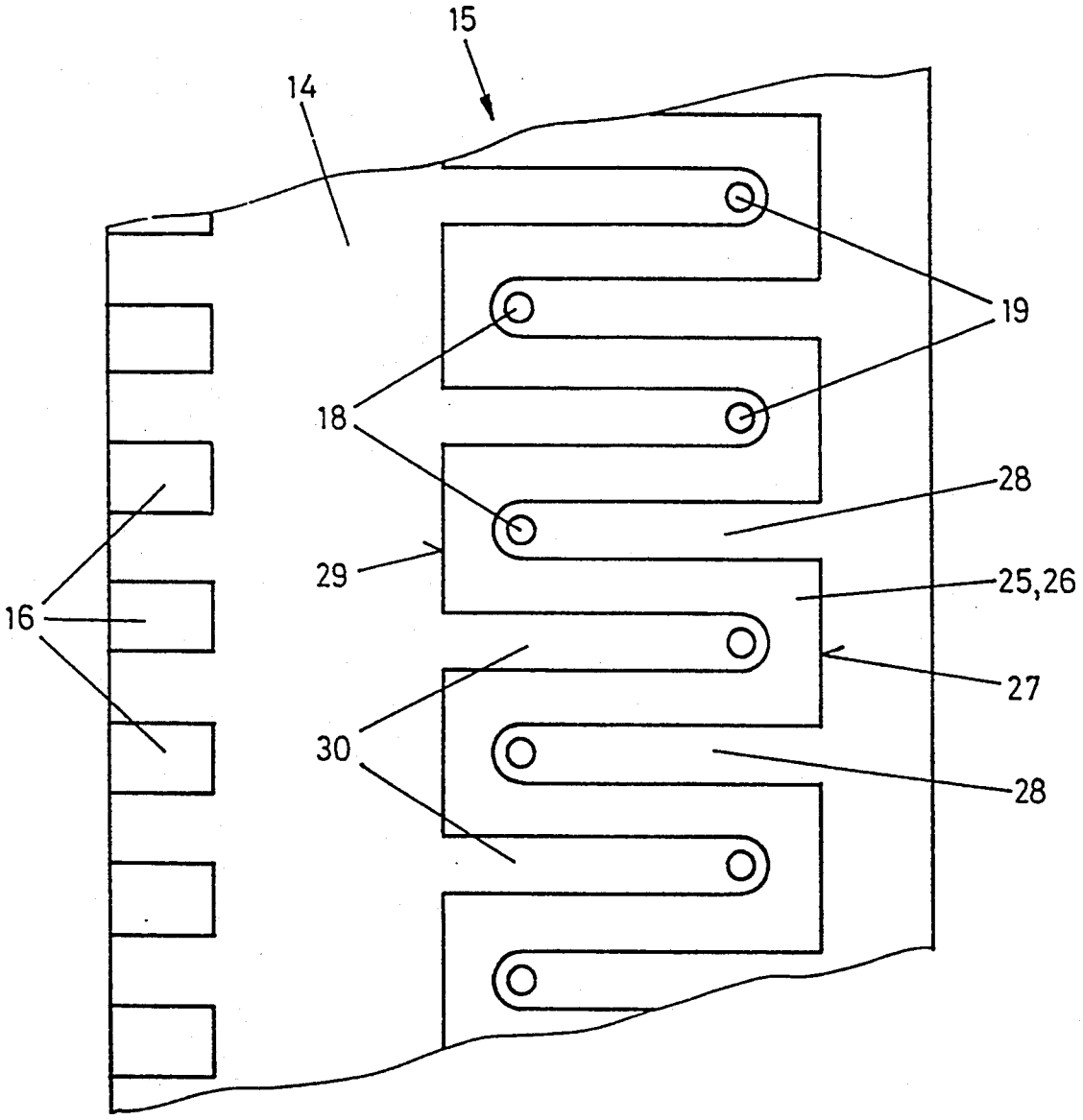
FIG. 2 shows a detail of the rotary valve.

The outer surface 20 of the cylinder 14 bears against a cylindrical, meander shaped second valve member 25 of rotary valve 15. A developed projection on the outer cylindrical surface 26 of part of valve member 25 and cylinder 14 is shown in FIG. 2. One axial face 27 and therefore half of the slots 28 of the meander is pressurised with supply pressure and connected to a high pressure hydraulic accumulator H and to a supply line S. The other axial face 29 and the other slots 30 are connected to a low pressure accumulator L and a return line R.

The above is a somewhat simplified description of rotary valve 15. A more detailed description is contained in Swiss Patent No. 559 088.

In operation the valve member 25 remains fixed with housing 2. When the cylinder 14 rotates the openings 18 communicate alternatively with the supply and the return and the openings 19 alternatively with the return and the supply so that by periodic pressure changes piston 10 reciprocates and hits on to the striking bar with a frequency proportional to the rotation rate of cylinder 14.

The striking bar 3 has a splined shaft section 35 which communicates with a splined bushing 36 connected to a gear 37. Gear 37 communicates with a further gear 38 which can be axially shifted from the normal position shown in FIG. 1 in two switch positions by supplying one or the other input line 39, 40 of a hydraulic cylinder 41 with pressure fluid. When pressure is released from both inputs 39, 40 the gear 38 returns to the neutral position by a centering spring 42. In the neutral position the gear 38 links with gear 37 and a pinion 43 which is coupled to pinion 17 by a shaft 44.

The internal bore of gear 38 is splined and sits on the splined end of an output shaft 49 of a reversible hydraulic motor 50. When gear 38 is shifted in its one end position it links with pinion 43 only and therefore only the percussion mechanism is in operation. This mode of operation is useful for transferring impacts to the threaded ends between two drill steels for loosening the coupling. When the gear 38 is shifted to the opposite end position it links exclusively with gear 37 so that the drill steel is rotated and the percussion mechanism is not operative. This mode of operation is useful for connecting and disconnecting drill rods and in some particular rock formations, for rotational drilling only.

In normal application, however, the gear 38 is in the neutral position shown in FIG. 1 so that the percussion frequency is proportional to the rotation rate of the drill rod. This proportionality provides optimum performance in most drilling applications, irrespective of the rock conditions.

Figure 3:
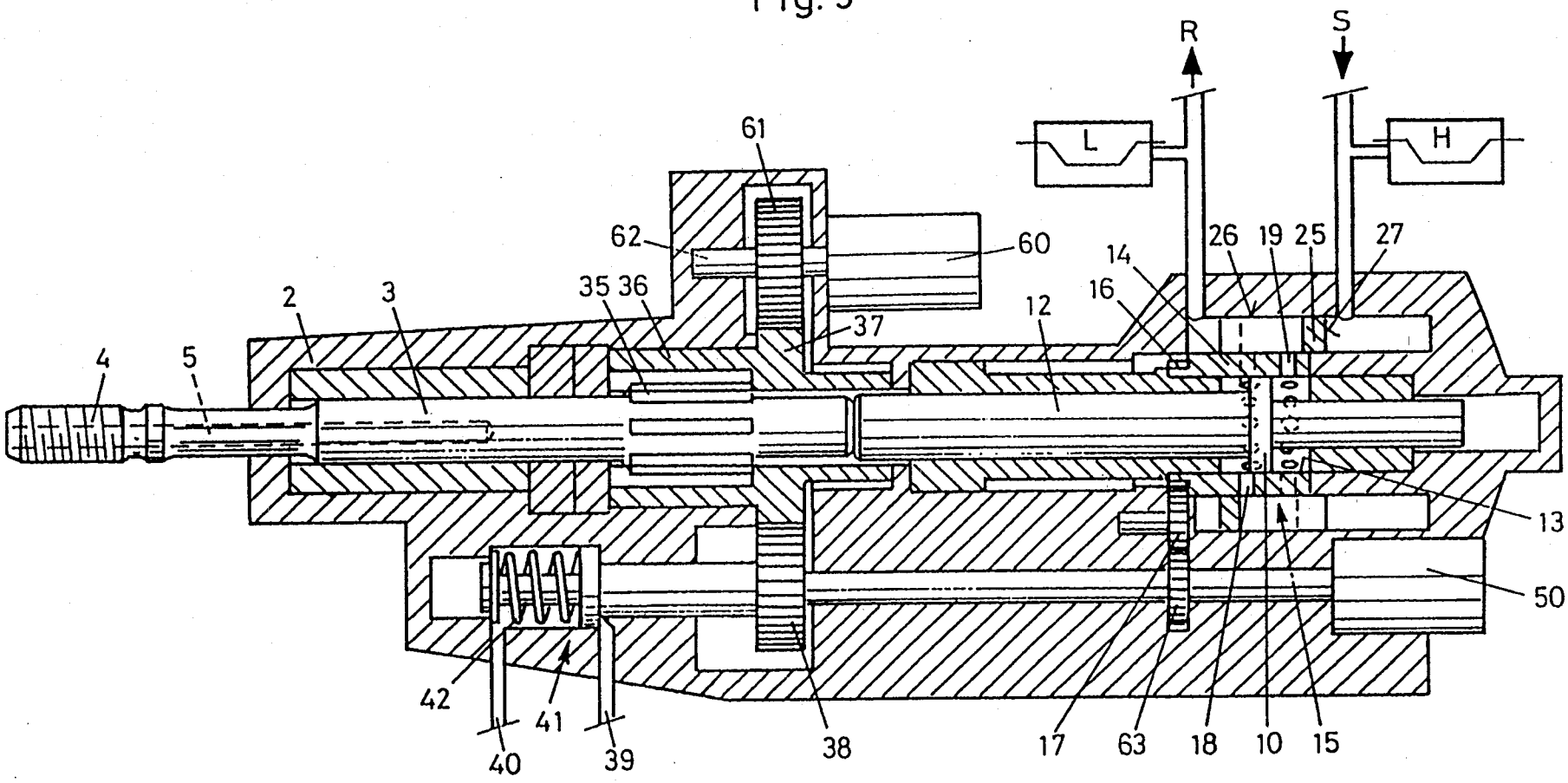
FIG. 3 shows a longitudinal section through a second embodiment.

In the embodiment shown in FIG. 3 like parts are designated with like reference numerals so that a detailed description of those parts need not be repeated.

The basic difference between the two embodiments is that in the FIG. 3 embodiment percussion and drill rotation can additionally be performed with individual motors 50, 60. To that end, a pinion 61 on an output shaft 62 of hydraulic motor 60 links with gear 37. Gears 37, 38 normally link so that motor 60 is the main motor. In normal operation motor 50 is idling, its two lines being connected to the return.

If pressure is applied to input 39 the piston 41 pulls gear 38 out of engagement with gear 37. The rotary valve 15 can now either be kept at rest (no percussion), or it can be operated at a frequency independent of the rotation rate of the drill rod by operating motor 50 via gears 63, 17. This may be of advantage in some particular rock formations.

The embodiment of FIG. 3 is therefore somewhat more versatile whereas the embodiment of FIG. 1 is less expensive.

What is claimed is:

1. A drilling device for a drill steel, comprising:

a housing (2);

a striking bar (3) for holding a rear end of said drill steel, said striking bar being supported in said housing (2) for rotation around an axis of said striking bar and for reciprocal movement along said axis;

a reversible first fluid motor (50, 60) having an output shaft (49, 62) coupled to said striking bar (3) for rotating said striking bar;

a percussion piston (10) for striking said striking bar (3), said piston being reciprocatingly received in a cylinder (14); and a fluid valve (15) connected to said cylinder (14) for reciprocating said piston (10) by periodic pressure changes; and a disconnectable first mechanical coupling (37, 38) between said output shaft (49, 62) and said fluid valve (15) for coupling a valve member of said fluid valve (15) with said output shaft.

2. The drilling device according to claim 1, further including a disconnectable second mechanical coupling (38, 37) connecting said output shaft (49) with said striking bar (3).

3. The drilling device according to claim 1, further comprising a second fluid motor (50) coupled to said fluid valve (15).

4. A drilling device for a drill steel, comprising:

a housing (2);

a striking bar (3) for holding a rear end of said drill steel, said striking bar being supported in said housing for rotation around a striking bar axis and for reciprocal movement along said axis;

a reversible first fluid motor (50, 60) having a first output shaft (49, 62);

a percussion piston (10) for striking said bar (3), said piston being reciprocatingly received in a cylinder (14) of said housing;

a fluid valve (15) connected to said cylinder (14) for controlling periodic pressure changes within said cylinder to reciprocate said piston;

a fixed-ratio transmission (38, 43; 38, 37) connecting said first output shaft (49, 62) to said striking bar to rotate said striking bar and connecting said first output shaft (49, 62) to said fluid valve (15) for controlling a reciprocation frequency of said percussion piston, said transmission being selectively engageable; and means for selectively engaging said transmission.

5. The drilling device according to claim 4, wherein said transmission includes rotary gears selectively engaged by relative axial sliding of said gears to selectively mesh and disconnect teeth of said gears.

6. The drilling device according to claim 4, wherein said transmission further comprises:

a fixed-ratio first transmission (38, 43) connecting said first output shaft (49, 62) to said fluid valve (15) for controlling a reciprocation frequency of said percussion piston, said first transmission being selectively engageable; and a fixed-ratio second transmission (38, 37) connecting said first output shaft (49, 62) to said striking bar to rotate said striking bar, said second transmission being selectively engageable.

7. The drilling device according to claim 6, wherein said first transmission and said second transmission include rotary gears and are selectively engaged by relative axial sliding of said gears to selectively mesh and disconnect teeth of said gears.

8. The drilling device according to claim 6, wherein said means for selectively engaging includes means for selectively engaging said first transmission and said second transmission.

9. The drilling device according to claim 8, wherein said means for selectively engaging said first transmission and said second transmission allows for engaging the first transmission but not the second transmission;

allows for engaging the second transmission but not the first transmission;

and allows for engaging simultaneously the first transmission and the second transmission.

10. The drilling device according to claim 9, wherein said first transmission and said second transmission include rotary gears and are selectively engaged by relative axial sliding of said gears to mesh and disconnect teeth of said gears.

11. The drilling device according to claim 4, further comprising:

a second motor (50);

and a second output shaft (62) coupled to said second motor (50);

said second output shaft (49) directly coupled to said fluid valve for controlling a reciprocation frequency of said percussion piston;

said first output shaft (62) is directly coupled to said striking bar to rotate said striking bar;

said transmission connects said first output shaft (62) to said fluid valve (15) for controlling a reciprocation frequency of said percussion piston and connects said second output shaft (49) to said striking bar to rotate said striking bar; and said means for selectively engaging includes means for disengaging said second output shaft (49) from said striking bar, whereby said second output shaft will not rotate said striking bar through said transmission.

12. The drilling device according to claim 11, wherein said transmission includes rotary gears selectively engaged by relative axial sliding of said gears to selectively mesh and disconnect teeth of said gears.

13. A drilling device for a drill steel, comprising:

a housing (2);

a striking bar (3) for holding a rear end of said drill steel, said striking bar being supported in said housing (2) for rotation around its axis and for reciprocal movement along its axis;

a reversible first fluid motor (60) with an output shaft (62) coupled to said striking bar (3) for rotating said striking bar;

a percussion piston (10) for striking said striking bar (3) and reciprocatingly received in a cylinder (14);

a fluid valve (15) connected to said cylinder (14) for reciprocating said piston (10); and a disconnectable first coupling (37,38) between said output shaft (62) and said fluid valve (15);

further comprising a second fluid motor (50) coupled to said fluid valve (15).

* * * * *